US005257071A

United States Patent [19]

Hediger

[11] Patent Number: 5,257,071

[45] Date of Patent: Oct. 26, 1993

[54] PIVOTAL PHOTOCONDUCTOR BELT ASSEMBLY

[75] Inventor: Edwin A. Hediger, Fairport, N.Y.

[73] Assignee: Eastman Kodak Company, Rochester, N.Y.

[21] Appl. No.: 705,406

[22] Filed: May 24, 1991

[51] Int. Cl.[5] ..... G03G 5/00

[52] U.S. Cl. ..... 355/212; 355/275

[58] Field of Search ..... 355/211, 212, 271, 275, 355/281, 200; 198/813

[56] References Cited

U.S. PATENT DOCUMENTS

| | | | |
|---|---|---|---|
| 4,339,196 | 7/1982 | Beck et al. | 355/251 |
| 4,376,577 | 3/1983 | Okamoto | 355/211 |
| 4,378,157 | 3/1983 | Hoffman | 355/77 |
| 4,527,686 | 7/1985 | Satoh | 355/212 X |
| 4,556,308 | 12/1985 | Hoppner et al. | 355/200 |
| 4,634,264 | 1/1987 | Takahashi | 355/200 |
| 4,739,371 | 4/1988 | Ray et al. | 355/212 |
| 4,983,146 | 1/1991 | Charles et al. | 355/212 X |
| 4,992,834 | 2/1991 | Yamamoto et al. | 355/299 |
| 4,996,563 | 2/1991 | Blanding | 355/212 |

OTHER PUBLICATIONS

IBM Technical Disclosure Bulletin, vol. 25, No. 10, Mar. 1983, "Tension Release Roller for Photoconductor Belt Assembly" by D. K. Gibson and S. W. Nosbisch.

*Primary Examiner*—Leo P. Picard
*Assistant Examiner*—Horgan, Christopher
*Attorney, Agent, or Firm*—J. Gary Mohr

[57] ABSTRACT

An electrophotographic apparatus including an endless photoconductive belt member supported by a plurality of rollers. The photoconductive belt is pivotal about an axis of one of the plurality of rollers for movement into an operational position. Pivoting about the axis, into the operational position, assures that the photoconductive belt will be under tension and positioned accurately in relation to the various process stations of the electrophotographic apparatus. The photoconductive belt is also pivotal about the same axis to a belt replacement position. In the belt replacement position the photoconductive belt is in a slacken condition and positioned for replacement, removal, installation or adjustment with minimal chance of damage to the photoconductive belt or other process stations of the electrophotographic apparatus during replacement, removal, installation or adjustment. In moving into the belt replacement or operational position, other processing stations of the electrophotographic apparatus are simultaneously pivoted about a different axis out of and into operational relation respectively.

5 Claims, 3 Drawing Sheets

PIVOTAL PHOTOCONDUCTOR BELT ASSEMBLY

BACKGROUND OF THE INVENTION

The instant invention relates to an apparatus to accomplish electrophotographic copying which, in general, includes charging a photoconductive member to a substantially uniform potential to sensitize the surface thereof. The charged portion of the photoconductive member is exposed to a light image reflected from an original document to be reproduced. The light image records an electrostatic latent image on the photoconductive member corresponding to the informational areas contained within the original document. After the electrostatic latent image is recorded on the photoconductive member, the latent image is toned. Thereafter, the toned image is transferred to a copy sheet. After transfer, heat and pressure are applied to the copy sheet to permanently fuse the toned image to the copy sheet.

As in all electrophotographic apparatus, the feeding and contact parameters, as well as ease of maintenance of the apparatus is essential to consistent latent image development. Since all photoconductive belts experience certain deviations from ideal location due to such things as mechanical tolerances of their support members or photoconductive belt wear, it becomes necessary to either realign or replace the photoconductive belt at certain intervals. Alignment or replacement of the photoconductive belt by an unskilled operator usually results in damage to the photoconductive belt, less than precise optical alignment or damage to one or more of the various process stations of the electrophotographic apparatus.

In the past, to obtain precise optical alignment, it required measuring or gauging on the part of the one replacing, repairing, installing or aligning the photoconductive belt. The present invention alleviates this problem by providing a mechanism that allows the alignment or replacement of the photoconductive belt to be accomplished without the need to measure or gauge. It also provides assurance that there will be minimal chance for damage to the photoconductive belt or the various process stations of the electrophotographic apparatus.

SUMMARY OF THE INVENTION

The present invention, while general to the field of electrophotographic copying and printing apparatus, more particularly relates to a multiple roller arrangement for an endless photoconductive belt supported by said rollers. The photoconductive belt is pivotal about its drive roller axis for movement into a position wherein the photoconductive belt is positioned for operational movement. Pivoting the photoconductive belt into its operational movement position automatically places the photoconductive belt in proper alignment with respect to the other process stations of the electrophotographic apparatus. The photoconductive belt is also pivotal about the same drive roller axis to a belt replacement position wherein the photoconductive belt is positioned to facilitate its replacement, removal, installation or adjustment. In movement into its belt replacement position, one or more of the other process stations of the electrophotographic apparatus are simultaneously pivoted about a different axis out of operational relation with the photoconductive belt. This movement minimizes the potential for damage to those stations and to the photoconductive belt during its replacement, installation or adjustment.

Accordingly, an object of the instant invention is to provide an improvement to an electrophotographic apparatus by providing a photoconductive belt, an exposure station and a developer station, all of which are pivotally interconnected. This improvement alleviates the aforesaid alignment and damage problems of the prior art. Accordingly, the invention has as a further object, a photoconductive belt pivotal about its drive roller axis into and out of operational relationship with a pivotal exposure and developer station. A still further object of the invention is to provide a locking device that causes slack in the photoconductive belt when the photoconductive belt is in its belt replacement position and restores the tension in the photoconductive belt when the photoconductive belt is returned to its operational position, thereby assuring high quality copying operations.

DESCRIPTION OF THE PREFERRED EMBODIMENT OF THE INVENTION

Figure 1:
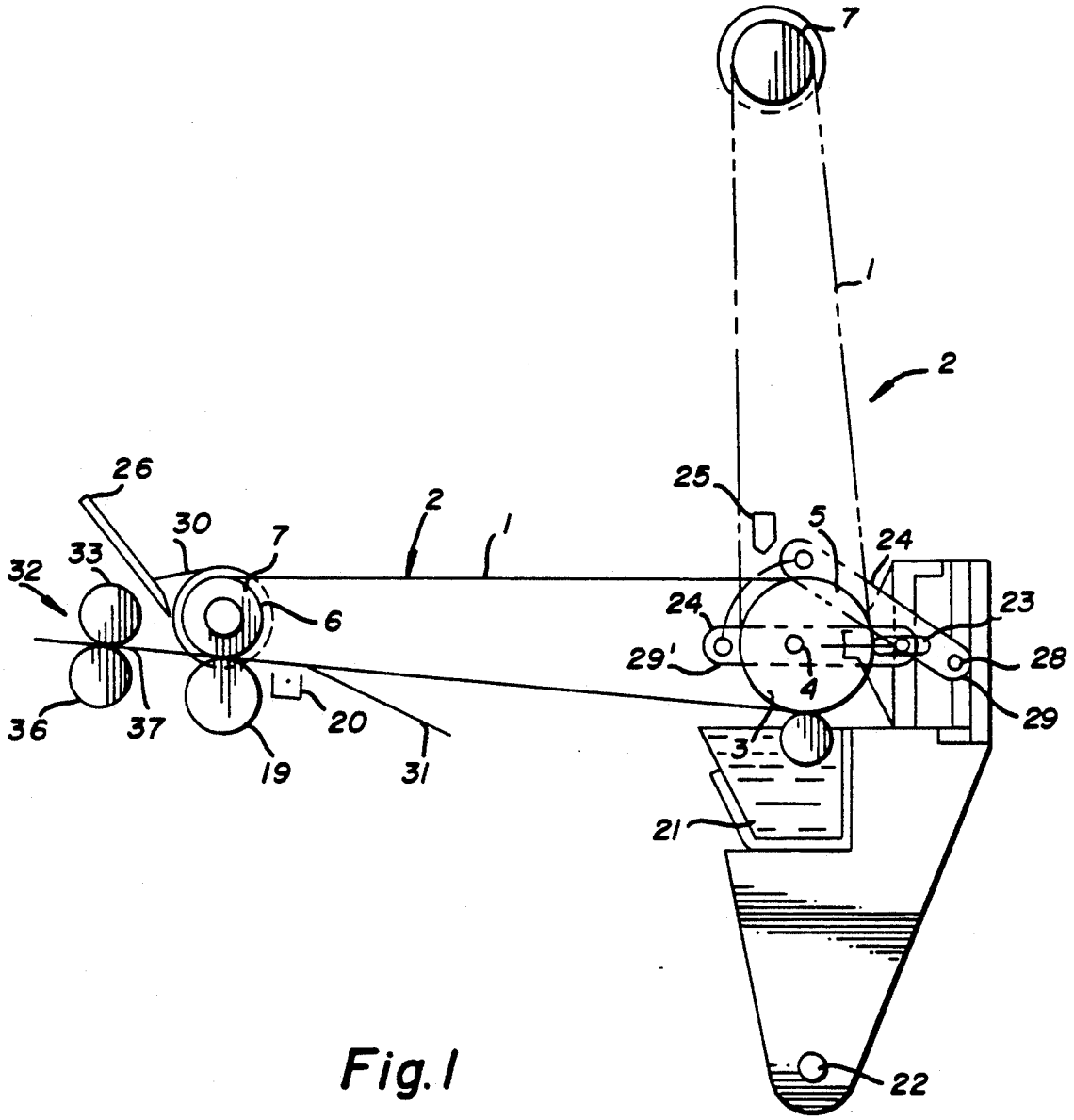
FIG. 1 is a schematic end view of the photoconductive belt assembly according to the present invention shown both in its operational and belt replacement positions.
Figure 2:
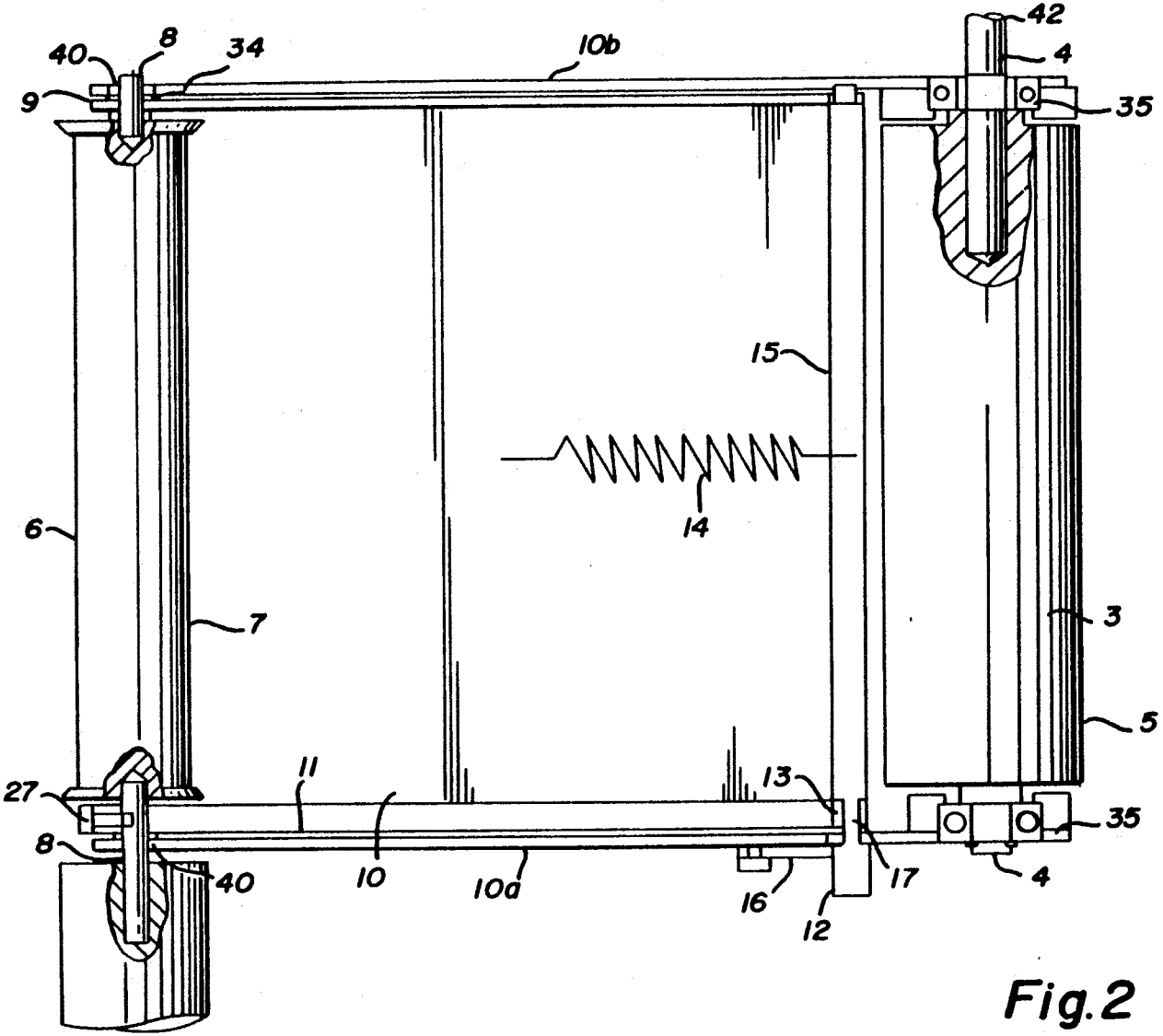
FIG. 2 is a schematic top view of the photoconductive belt assembly according to the present invention shown in its operational position with the belt removed.
Figure 3:
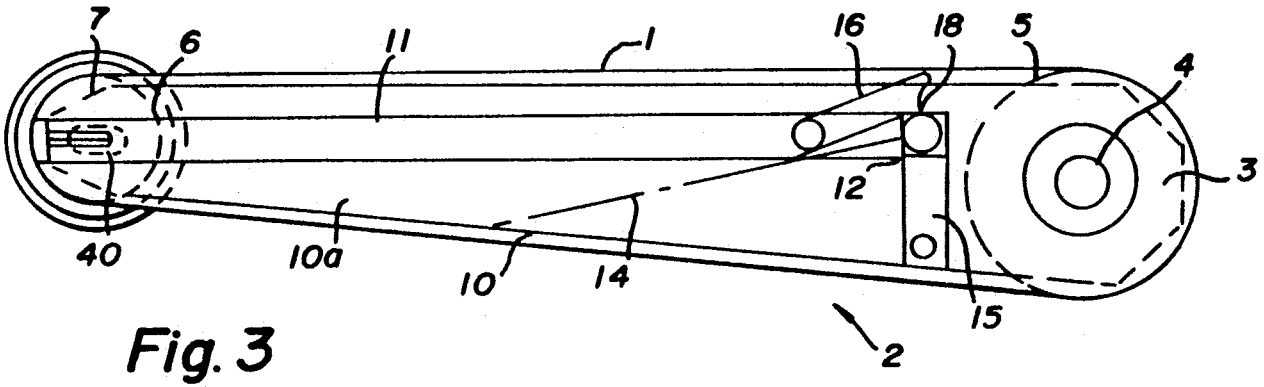
FIG. 3 is a schematic end view of the photoconductive belt assembly according to present invention in its operational position.
Figure 4:
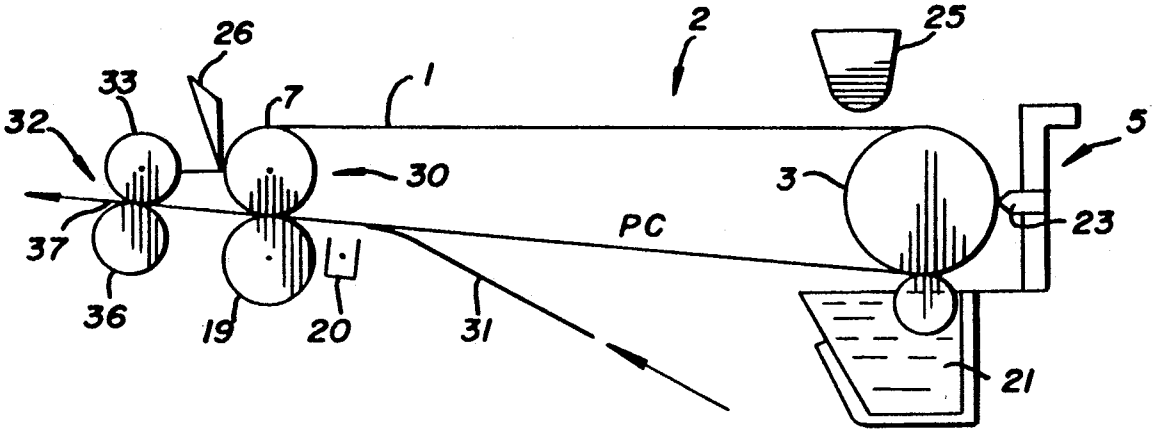
FIG. 4 is a schematic end view of the typical prior art photoconductive belt assembly.

In describing the preferred embodiment of the instant invention, reference is made to the drawings, wherein like numerals indicate like parts and structural features in the various views, diagrams and drawings. FIG. 1 schematically shows the photoconductive belt 1, both in its operational and belt replacement positions, but without the structural members of photoconductive belt assembly 2, as shown in FIGS. 2 and 3. Photoconductive belt 1 is of the endless flexible type and is driven in a clockwise motion. It may, however, be driven counterclockwise with the repositioning of various process stations of the electrophotographic apparatus.

Belt 1 rides on a portion of the outer circumference 5 of drive roller 3 of belt assembly 2. The photosensitive image surface of photoconductive belt 1, when photoconductive belt 1 is in motion, is acted upon by a series of processing stations, namely a charging station 25 comprised of a corona-generating device, not shown, an exposure station 23, a developing station 21, a transfer charger station 20, a transfer station 30, consisting of transfer pressure roller 19 and tension roller 7, and a cleaning station 26, all of which are known in the art.

As shown in FIGS. 1 and 2, belt assembly 2 and its photoconductive belt 1 are driven and pivot about drive roller 3 which is mounted for rotation with drive shaft 4. Drive shaft 4 rotates within bearings 35 which are securely fixed to a support assembly 10 for maintaining drive shaft 4 and drive roller 3 in a fixed, but rotatable, position within support assembly 10. Drive shaft 4 and drive roller 3 are further rotatable and fixed in their positions by having end 4*a*, of drive shaft 4 secured to a drive mechanism, not shown. Said drive mechanism causes drive shaft 4 to rotate. Additionally, rotational bearings and mounts, not shown, located at end 4*a*, of shaft 4, further aid in maintaining shaft 4 and drive roller 3 in a fixed position when belt assembly 2 is moved into or out of its belt replacement or operational positions.

Looking again at FIGS. 2 and 3, photoconductive belt 1 rides on the outer circumference 5 of drive roller 3 and the outer circumference 6 of tension roller 7. Tension roller 7 is mounted for rotation with tension shaft 8, as shown in FIG. 2. Separating tension shaft 8 and drive shaft 4 is support assembly 10, see FIG. 2. Side 10*a* and side 10*b* of support assembly 10 are constructed and supported in parallel relationship to each other. In addition, support assembly 10 is positioned and sized so that it is located entirely within the path of travel of photoconductive belt 1, see FIG. 3. This internal positioning prevents support assembly 10 from interfering with installation or removal of photoconductive belt 1 from photoconductive belt assembly 2.

In order for photoconductive belt 1 to maintain its designated path of travel, it should be understood that while tension shaft 8 rotates both within elongated slots 40 of support assembly 10 and adjusting channel 11, see FIGS. 2 and 3, it does not, when the photoconductive belt 1 is in operation, move laterally in said elongated slots 40. In addition, tension shaft 8 is prevented, during operation of photoconductive belt 1, from lateral movement by having one of its ends rotate within the confines of bearing housing 34 of support bar 9 located adjacent and parallel to side 10*b* of support assembly 10. The other end of tension shaft 8 is prevented from lateral movement in elongated slots 40 by both the tension of photoconductive belt 1 and the bias of adjusting bolt 27 located at the end of adjusting channel 11.

In FIG. 2, spring 14 is shown with one of its ends attached to retaining assembly 15. This biases retaining assembly 15 away from drive roller 3. The other ends of spring 14 is secured to support assembly 10. The bias of spring 14 on adjusting channel 11, through its interaction with retaining assembly 15, prevents adjustment channel 11 from moving toward drive roller 3. In addition, as shown in FIG. 3, since adjusting channel 11 and retaining assembly 15 are structurally interconnected, they are both constrained from movement laterally away from drive roller 3 by the tension that photoconductive belt 1 places on adjustment channel 11 through tension shaft 8. Because of these restraints on tension shaft 8 and the ability to adjust the lateral position of tension shaft 8 through adjusting bolt 27, shaft 8 is maintained parallel to shaft 4 and constrained, when photoconductive belt 1 is in its operational position, to a single position within elongated slots 40. This assures that photoconductive belt 1 will be maintained in its designated path of travel.

As previously shown, when photoconductive belt 1 is in its operational position, spring 14 urges retaining assembly 15 and tension roller 7, through its interconnection with adjusting channel 11, laterally away from drive roller 3 causing photoconductive belt 1 to become taut between drive roller 3 and tension roller 7. Since retaining assembly 15 is both positioned in bearing retaining slot 13 of adjusting channel 11 and elongated slot 40 of side 10*a* of support assembly 10 it can be urged by tension release latch 16, which is pivotally connected to adjustment channel 11, towards driver roller 3. This is accomplished by moving knob 12 attached to the reduced portion 17, of assembly 15 after it passes through elongated slot 40 of side 10*a* of support assembly 10 toward drive roller 3. Once this movement is accomplished, the tension caused by spring 14 on adjusting channel 11 is relieved. Knob 12 is maintained in this position by end 18 of release latch 16 making contact with knob 12. The relieving of the tension caused by spring 14 on adjustment channel 11, in turn, removes the biasing force placed upon tension roller 7 by photoconductive belt 1, thereby producing slack in photoconductive belt 1. Once there is slack in photoconductive belt 1, the removal of photoconductive belt 1 from drive roller 3 and tension roller 7 is easy to accomplish.

When end 18, of tension release latch 16, is disengaged from mating contact with knob 12, of retaining assembly 15, adjusting channel 11 is again placed under the bias of spring 14 and the constraint of photoconductive belt 1. This causes photoconductive belt 1 to be taut between drive roller 3 and tension roller 7. Retaining assembly 15 having reduced section 17, where it passes through elongated slot 40 of side 10*a* of support assembly 10, is free to move in elongated slot 40 when acted upon by the bias of spring 14 or tension release latch 16.

Returning to FIG. 1, developer station 21 is shown securely attached to exposure station 23. In addition exposure station 23 is pivotally secured at 28 to one end 29 of disengage link 24. The other end 29', of disengage link 24, is pivotally secured to side 10*a* of support assembly 10. The pivoting of belt assembly 2, about drive shaft 4 and the interaction this causes with disengage link 24, causes developing station 21 and exposure station 23 to simultaneously pivot about shaft 22 and out of operational contact relation with photoconductive belt 1. The pivoting motion of belt assembly 2 also causes photoconductive belt 1 to simultaneously move out of operational relationship with transfer roller 19 and transfer charger 20. The need for precise interaction among the various components of the electrophotographic apparatus is to assure proper alignment of all components without the time consuming operation of measuring or gauging. The need for proper alignment of the components can best be understood by the following which describes how the operating components interact to assure quality copying.

When the photoconductive belt 1 is in its operational position as shown in FIGS. 2 and 3, and the copying process begins, the photosensitive image surface of the photoconductive belt 1 is sensitized by charger 25 before being exposed, at exposure station 23, to the reflected image to be copied. The exposed photosensitive image surface of photoconductive belt 1 is thereafter passed through development station 21 for toning. The toned image is then transferred, to a copy sheet 31 at transfer station 30, from the photoconductive belt 1. After transfer of the toned image to copy sheet 31, copy sheet 31, bearing the toned image, is stripped from the photoconductive belt 1 and conveyed to a fusing station 32 comprised of heated roller fuser 33 and pressure roller 36. The toned image is fixed at fusing station 32 to copy sheet 31 by the heat and pressure contained in nip 37 located between rollers 33 and 36 of the fuser station 32. After fixing the image on copy sheet 31, copy sheet 31 is discharged into a catch tray, not shown, for collection by the operator. Unless all the heretofore mentioned stations are properly aligned. copy quality can not be assured.

Now that the operation of photoconductive belt 1 has been explained, it should be clear that the photoconductive belt 1, is placed in its belt replacement position, by pivoting it about drive roller 3. This pivoting, in conjunction with the engaging of release latch 16, allows one to work on photoconductive belt 1 free from any obstruction that would be caused by transfer roller 19 if it were in contact with photoconductive belt 1. Additionally, one is not hampered from working on photoconductive belt 1 by any obstruction caused by developer station 21 or exposure station 23, since their simultaneously pivoting about shaft 22 takes them out of contact with photoconductive belt 1. This is due to the interaction between exposure station 23 and side 10*a* of support assembly 10 through disengage link 24 as photoconductive belt 1 pivots about drive roller 3. Further, since this pivoting relieves photoconductive belt 1 of the tension caused by spring 14, a slacken condition in photoconductive belt 1 results, and therefore photoconductive belt 1 is free to be removed, installed, replaced or adjusted with minimal risk of damage to photoconductive belt 1 or any other processing stations of the electrophotographic copying apparatus.

While the present invention has been described with the reference to the particular structure disclosed herein, it is not intended that it be limited to the specific details, and this application is intended to cover such modifications or changes as may come within the purposes of the improvements or scope of the claims forming a part hereof.

I claim:

1. An improved electrophotographic apparatus of the type having:

a sensitizing charger station, an exposure station, a development station, a transfer station, a fusing station and means for moving an endless photoconductive belt through at least one of the stations, with the photoconductive belt being supported by a plurality of rollers, the improvement comprising means for pivoting the photoconductive belt about a first pivotal point which is an axis of one of the plurality of rollers into and out of operational engagement with at least one of said stations and means for pivoting the developer and exposure station as one unit about a second pivotal point, into and out of operational engagement with the photoconductive belt and at least a portion of the transfer station travels with photoconductive belt as said belt is pivotal about the first pivot point.

2. The improvement of claim 1, wherein a means is provided for maintaining the photoconductive belt under tension when in operational engagement with the various stations and in a slacken condition when in a repair position.

3. The improvement of claim 2, wherein there is provided a means to maintain the photoconductive belt in a designated path of travel between at least two rollers of the plurality of rollers and there is a support means and a biasing means for the rollers located within the photoconductive belt's path of travel that maintains the photoconductive belt in its path of travel.

4. The improvement of claim 3 wherein the biasing means is pivotal on the support means.

5. The improvement of claim 3 wherein the biasing means and support means are both pivotal about the first pivotal point.

* * * * *